United States Patent [19]

Maréchal et al.

[11] Patent Number: 4,859,258

[45] Date of Patent: Aug. 22, 1989

[54] METHOD OF MANUFACTURING A FLEXIBLE ELECTRIC CABLE INCLUDING A CONDUCTOR COMPRISING A PLURALITY OF FINE STRANDS OF ALUMINUM OR ALUMINUM ALLOY

[75] Inventors: Michel Maréchal, Combs La Ville; Alain Rageot, Draveil; Michel Basly, Juvisy sur Orge, all of France

[73] Assignee: Societe Anonyme dite: Filotex, Draveil, France

[21] Appl. No.: 177,264

[22] Filed: Apr. 4, 1988

[30] Foreign Application Priority Data

Apr. 3, 1987 [FR] France ..... 87 04691

[51] Int. Cl.[4] ..... H01B 13/06

[52] U.S. Cl. ..... 156/51; 156/50; 156/56; 174/36; 174/113 R; 174/128.1; 427/120

[58] Field of Search ..... 156/50, 51, 56; 174/36, 174/113 R, 128.1, 128.2; 427/116, 117, 120

[56] References Cited

U.S. PATENT DOCUMENTS 3,795,760 3/1974 Raw et al. ..... 174/128.1
4,552,599 11/1985 Masuda et al. ..... 156/50

FOREIGN PATENT DOCUMENTS 884833 7/1953 Fed. Rep. of Germany .
1281150 11/1961 France .

*Primary Examiner*—Robert A. Dawson
*Attorney, Agent, or Firm*—Sughrue, Mion, Zinn, Macpeak & Seas

[57] ABSTRACT

A method of manufacturing a flexible electric cable constituted by a polymer-coated stranded conductor made up of fine strands of aluminum or aluminum alloy having a diameter of less than 0.5 mm, or constituted by one or more insulated conductors surrounded by an electric screen itself constituted by fine strands of aluminum or aluminum alloy having a diameter of less than 0.5 mm and wrapped or braided about the conductor(s). The screen is surrounded by at least one insulating layer of polymer material, wherein the operation of stranding together the fine strands forming the conductor or of wrapping or braiding the strands surrounding the insulated conductor(s) and forming the electric screen is performed by using fine strands which are not annealed or which are only partially annealed, with the stranded conductor or the wrapped or braided electric screen then being covered with insulation and subjected to at least one final annealing operation.

5 Claims, 1 Drawing Sheet

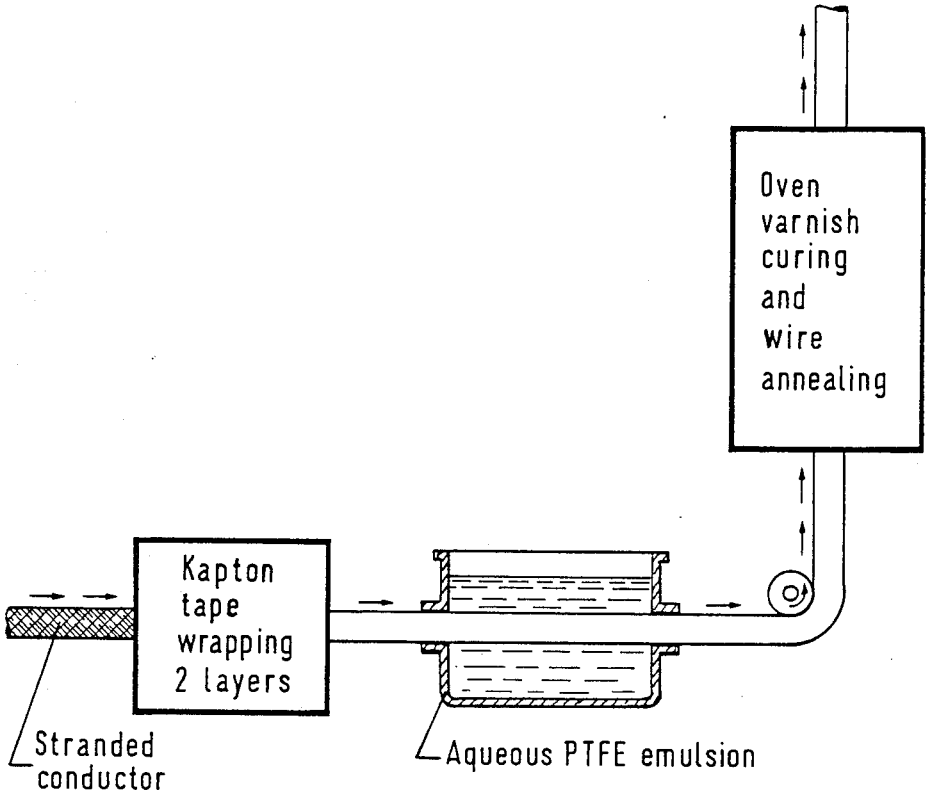
Oven
varnish
curing
and
wire
annealing
Kapton
tape
wrapping
2 layers
Stranded
conductor
Aqueous PTFE emulsion

METHOD OF MANUFACTURING A FLEXIBLE ELECTRIC CABLE INCLUDING A CONDUCTOR COMPRISING A PLURALITY OF FINE STRANDS OF ALUMINUM OR ALUMINUM ALLOY

The present invention relates to a method of manufacturing a flexible electric cable constituted by a polymer-coated stranded conductor made of fine strands of aluminum or aluminum alloy having a diameter of less than 0.5 mm, or constituted by one or more insulated conductors surrounded by an electric screen itself constituted by fine strands of aluminum or aluminum alloy having a diameter of less than 0.5 mm and wrapped or braided about the conductor(s), said screen being surrounded by at least one insulating layer of polymer material.

BACKGROUND OF THE INVENTION

Such cables are used in particular for cabling aircraft and spacecraft. They are generally constituted by a conducting core comprising twisted fine strands and insulation constituted by one or more layers of one or more polymer materials. These materials may either be directly extruded over the conducting core or else they may initially be formed into tapes, which tapes are then helically wound around the conducting core. Such insulation is itself frequently coated with a layer of enamel obtained by oven curing a varnish. The insulated conductor or bundle of insulated conductors may be surrounded by an electric screen constituted by wrapped or braided fine strands. The electric screen is itself generally covered with electrical insulation which may be extruded or taped, and which may optionally be coated in enamel.

The insulating polymers and the enamels used are frequently polyimides or fluorine-containing resins or any other material which retains good mechanical properties and electrical insulating properties at operating temperatures of more than about 150° C.

In order to obtain flexible cables and to reduce electrical resistance, it is essential for the metal of the conductors to be suitably annealed. However, when using conductors comprising fine strands having a diameter of less than 0.5 mm, it is known that annealed wires of aluminum or of aluminum alloy are fragile and that they poorly understand the sudden changes in force to which they are subjected during the stranding, insulating, or braiding operations applied thereto, which sudden variations cannot be entirely eliminated in spite of the care taken with said operations of stranding, braiding, wrapping, or insulating. As a result numerous breaks occur in the strands during a manufacturing cycle, which breaks are all the more bothersome since to improve cable flexibility the number of strands is increased while their diameter is reduced.

The object of the present invention is to enable flexible electrical cables to be manufactured comprising strands made of aluminum or aluminum alloy having a diameter of less than 0.5 mm, and which may be as little as about 0.05 mm, while very considerably reducing the risks of breakage during stranding, braiding, wrapping, or insulating operations.

SUMMARY OF THE INVENTION

The method according to the invention is characterized in that the operations of stranding together the fine strands forming the conductor or of wrapping or braiding the strands surrounding the insulated conductor(s) and forming the electric screen are performed by using fine strands which have not been annealed or which have been only partially annealed, with the stranded conductor or wrapped or braided electric screen then being covered with insulation and subjected to at least one final annealing operation.

The present invention preferably satisfies at least one of the following features:

- when the insulation is finished off with a layer of varnish based on a polymer material after the fine strands forming the conductor have been stranded and the insulation has been applied, or after the wires forming the electric screen have been wrapped or braided and the insulation has been applied, the insulated conductor or the insulated electric screen is coated with a layer of varnish based on a polymer material, and the varnish coated insulated conductor or insulated electric screen is subjected to heat treatment for simultaneously curing the varnish and annealing the conductor or the electric screen;
- when the varnish is based on fluorine-containing resins, the insulated conductor or the insulated electric screen is annealed simultaneously with the varnish being cured by passing through an oven at 450° C. for about 30 seconds; and
- the insulated conductor or the electric screen is annealed in an oven whose temperature is not less than 240° C.

The method of the invention is particularly suitable for cables containing fine strands made of aluminum or aluminum alloy and covered with a layer of nickel, said strands being particularly appreciated by users when the conductor(s) or the screen of a cable is/are to be connected at the cable end to electrical components such as contacts or other cables by crimping or by soldering. The nickel layer eliminates the bad contacts inherent to surface oxidation of aluminum. It also adheres well to tin or silver based solders.

As is well known, the mechanical properties of the strands and in particular the breaking stress thereof are greater, when not fully annealed, than the same properties of the same wires once fully annealed. The annealing heat treatment which is necessary for obtaining the flexibility and the better electrical conductivity required by the cables takes place after the operations of stranding and insulating the conductor, or after the operation of wrapping or braiding the screen.

The particular metallurgical states corresponding to the terms "annealed", "semi-work hardened" and "work-hardened" vary between different wire manufacturers and different countries. For example, in France these states are defined for wires made of aluminum or of aluminum alloy by French standard NF A 02-006, and the guaranteed values of the mechanical characteristics are specified for each metallurgical state by the supplier. In any event, there are always several metallurgical states for any aluminum or of aluminum alloy wire not included within the annealed state for which the value of the breaking stress is considerably greater than the value observed in the annealed state.

The heat treatment which gives rise to a properly annealed wire depends on the purity of the metal or on the composition of the alloy. It also depends on the metallurgical states and on the heat treatments to which the metal has been subjected during manufacturing stages prior to annealing. This heat treatment is characterized by the temperature to which the wire should be raised and by the length of time it is to spend at this temperature. For aluminum and numerous alloys, the temperature must not be less than 240° C., and in this case the duration may be several hours. However, if a higher temperature is used, e.g. greater than 350° C., the duration may be reduced to a fraction of a second.

The insulation used on flexible cables, particularly on cables for use in aircraft and spacecraft, is capable of withstanding such temperatures for periods of time running from a few seconds to several hours depending on the insulating material used.

It is thus possible to anneal the stranded conductor and the wrapped or braided screen even when coated with insulation. Annealing may even be combined with the operation of curing the varnish which may optionally be coated on the layer(s) of insulation

BRIEF DESCRIPTION OF THE DRAWING

An implementation of the invention is described by way of example with reference to the accompanying drawing, in which the sole figure is a diagram showing a stranded conductor being being annealed by the same heat treatment as is used for curing its outer layer of varnish.

MORE DETAILED DESCRIPTION

By way of example, the Inventors have made a stranded conductor comprising 19 strands each having a diameter of 0.15 mm. These strands are made of 131050 aluminum as defined by French standard NF A 02-104, and are covered with a layer of nickel which is about 1 micron thick. The strands were stranded together while in the work-hardened metallurgical state corresponding to designation H26 in French standard NF A 02-006. In this state, the breaking stress is greater than 160 MPa and elongation at rupture is about 1%. As shown in the figure, the stranded conductor was insulated by two layers of polyamide tape sold under trademark Kapton (by Dupont de Nemours). These tapes were 25 microns thick. The insulated conductor was coated with a layer of varnish constituted by an aqueous emulsion of polyetetrafluoroethylene (PTFE) by passing through a bath of said emulsion. The conductor coated in this way then passed at a speed of 20 meters per minuite (m/min) through a vertical oven heated to 450° C. The staying time in the oven for each portion of the insulating conductor was about 30 seconds. These operating conditions served to cure the varnish and to anneal the aluminum strands constituting the stranded conductor. After treatment, strands taken from the conductor had a breaking elongation of greater than 12%. However, the breaking stress was no longer greater than 130 MPa. These characteristics correspond to the annealed metallurgical state which guarantee the required flexibility and electrical conductivity.

In another embodiment, two conductors made in this way were twisted together to form a pair. A braid constituted by 16 sets of three strands made of nickel-coated aluminum 131050 as explained above was applied over this pair. The diameter of the strands was 0.12 mm. They were used in a partially workhardened metallurgical state corresponding to designation H24 of French standard NF A 02-006, since the fully work-hardened metallurgical state H26 is not suitable for braiding. In this H24 state, the breaking stress of each strand lies between 140 MPa and 150 MPa. The breaking elongation lies between 3% and 4%. The braid was then insulated by two layers of Kapton tape and one layer of fluorine-containing varnish as explained above. The cable made in this way was then passed through the same oven under the same operating conditions as explained above. Tests performed on strands taken from the braid after this treatment gave the same result, i.e. a breaking stress of less than 130 MPa and a breaking elongation of more than 12%, thus guaranteeing the required flexibility and conductivity.

As mentioned above, the temperature and the period spent in the oven may vary over wide ranges while still annealing the stranded conductor or the screen. This makes it possible, inter alia, to select operating conditions to take account of other constraints related, in particular, to the characteristics of the insulating materials used. In the above examples, the temperature of the oven was fixed to a high value as required for curing a fluorine-containing varnish.

We claim:

1. A method of manufacturing a flexible electric cable comprising fine metal strands at least partially of aluminum having a diameter of less than 0.5 mm and being in the form of one of a polymer coated stranded conductor and a wrapped or braided electric screen of said fine metal strands surrounding an insulated conductor, surrounding said strands by at least one insulating layer of polymer material, and wherein the stranding to form the conductor or wrapping or braiding strands to surround said insulated conductor(s) to form the electric screen, is with fine strands which are at the most only partially annealed and, wherein after stranding together the fine metal strands and applying insulation, the insulated conductor or the insulated electric screen is coated with a layer of varnish based on a polymer material, and the varnish coated insulated conductor or insulated electric screen is heat treated for simultaneously curing the varnish and annealing the fine metal strands.

2. A method according to claim 1, further comprising the steps of finishing off the insulation with a layer of varnish based on a polymer material, wherein after stranding together the fine metal strands and applying insulation, the insulated conductor or the insulated electric screen is coated with a layer of varnish based on a polymer material, and the varnish coated insulated conductor or insulated electric screen is heat treated for simultaneously curing the varnish and annealing the fine metal strands.

3. A method of according to claim 2, in which the varnish is based on fluorine-containing resins, and wherein the fine metal strands of the insulated conductor or the insulated electric screen is annealed by being passed through an oven at 450° C. for about 30 seconds.

4. A method according to claim 1, wherein the fine metal strands are annealed in an oven at a temperature of not less than 240° C.

5. The method according to claim 1 for manufacturing flexible electrical cables which are easily crimped or soldered to other electrical components, and wherein said method further comprises the step of coating said strands in a layer of nickel.

* * * * *